US006471430B1

(12) United States Patent
Gaus et al.

(10) Patent No.: US 6,471,430 B1
(45) Date of Patent: Oct. 29, 2002

(54) INSTALLATION FOR PRODUCING SHEET-SHAPED PRINTED ARTICLES

(75) Inventors: Rainer Gaus, Waakirchen (DE); Gerhard Bach, Schnelldorf (DE); Kai K. O. Bär, Bad Aibling (DE)

(73) Assignee: Industrieservis Gesellschaft fur Innovation, Technologie-Transfer und Consulting fur Thermische Prozessanlagen mbH, Bruckmuhl (DE)

( * ) Notice: Subject to any disclaimer, the term of this patent is extended or adjusted under 35 U.S.C. 154(b) by 0 days.

(21) Appl. No.: 09/485,589

(22) PCT Filed: Aug. 7, 1998

(86) PCT No.: PCT/EP98/05016

§ 371 (c)(1),
(2), (4) Date: May 5, 2000

(87) PCT Pub. No.: WO99/08878

PCT Pub. Date: Feb. 25, 1999

(30) Foreign Application Priority Data

Aug. 13, 1997 (DE) ..... 197 35 070

(51) Int. Cl.[7] ..... B41J 13/08

(52) U.S. Cl. ..... 400/635; 400/624; 347/102; 271/276

(58) Field of Search ..... 347/102, 104, 347/19; 400/624, 635; 271/5, 6, 10.1, 11, 276

(56) References Cited

U.S. PATENT DOCUMENTS 5,668,581 A * 9/1997 Tsuji et al. ..... 347/37
5,757,407 A * 5/1998 Rezanka ..... 347/102
5,764,263 A * 6/1998 Lin ..... 347/101
5,810,350 A * 9/1998 Pollich ..... 271/276

FOREIGN PATENT DOCUMENTS

JP 07-092831 A * 4/1995

* cited by examiner

*Primary Examiner*—Daniel J. Colilla
(74) *Attorney, Agent, or Firm*—Hoffmann & Baron, LLP

(57) ABSTRACT

The invention proposes a system for manufacturing sheet-like printed products (3), in which sheet-like starting sections (2) are processed. These starting sections are transported through at least one printing station (13) by means of a transport device (4). The application of a printed image takes place in the printing station (13) with the aid of a printer (26) and a subsequently arranged dryer (32), with an electronic printed image specification device (43) making it possible to realize individual printed images on individual sheets.

11 Claims, 1 Drawing Sheet

INSTALLATION FOR PRODUCING SHEET-SHAPED PRINTED ARTICLES

Figure 1:
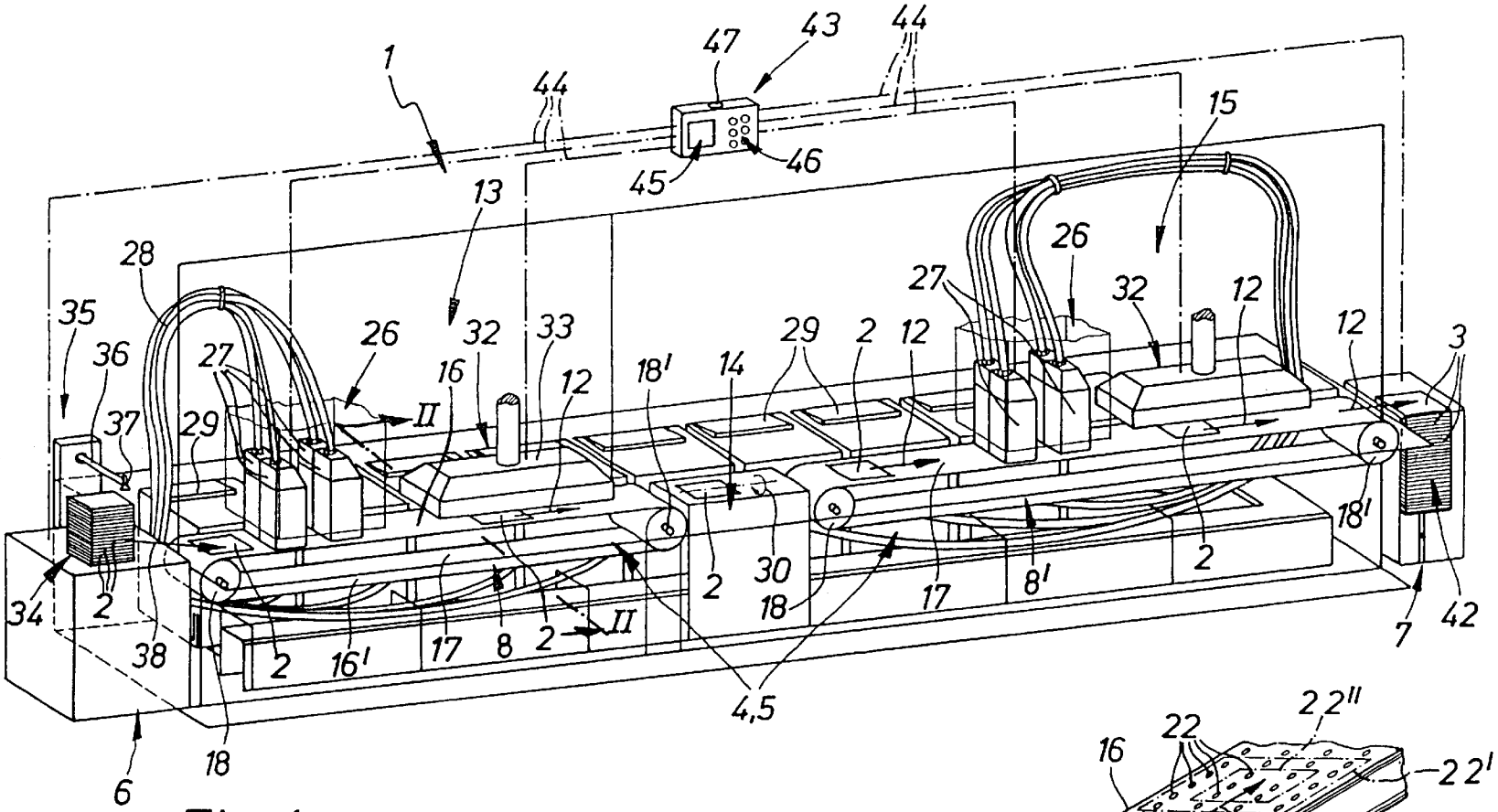

The invention pertains to a system for manufacturing sheet-like printed products, e.g., pamphlet sheets, magazine sheets or invoice sheets, with a transport device that transports the starting material to be printed from a feed station through a printing station, in which at least one printed image is applied onto the starting material.

Systems of this type are, for example, used for manufacturing pamphlet sheets, magazine sheets, invoice sheets or similar sheet-like printed products which are printed on one or both sides and usually consist of paper material. In systems known so far, endless starting material that is wound into reels is processed. This starting material is continuously transported, among other things, through a printing station by means of a transport device that contains a series rollers or cylinders. The desired printed image is applied onto the web-shaped starting material in the printing station with the aid of a printing cylinder that adjoins the starting material. After the printing process, the printed starting material is cut to the desired format such that individual sheet-like printed products are ultimately obtained.

The disadvantages of these known systems are the relatively low processing speed and the lack of flexibility in applying the printed image. Consequently, the present invention is based on the objective of developing a system of the initially mentioned type which allows a very flexible manufacture of sheet-like printed products with high processing speed and high precision.

According to the invention, this objective is attained due to the fact that the feed station contains a transfer device for transferring starting material in the form of sheet-like starting sections to the transport device, the fact that the transport device is equipped with a vacuum conveyor belt, on which the sheet-like starting sections to be printed are held during their transport due to the vacuum, the fact that the printing station is equipped with a printer that operates in a contactless fashion and is preferably realized in the form of an ink jet printer as well as a dryer that is arranged behind the printer viewed in the transport direction of the starting sections, and the fact that an electronic printed image specification device that cooperates with the printer and makes it possible to specify individual printed images for the sheets is provided.

These measures result in a system in which endless starting material is not printed, but rather starting material in the form of formatted, sheet-like starting sections. The sheet-like starting sections are transported through the printing station with the aid of the vacuum conveyor belt, with the retention of the starting sections on the vacuum conveyor belt due to the vacuum allowing very high transport speeds without impairing the alignment of the starting sections. The processing of sheet-like starting sections provides the additional advantage that certain finishing treatments can be carried out before the starting sections are fed to the system, e.g., certain folds of the starting sections, without impairing the processing options in the system according to the invention. Due to the utilization of a printing station that is equipped with a contactless printer, the desired printed image can be easily varied without complicated resetting procedures, with a high precision always being ensured. The subsequently arranged dryer also ensures a reliable drying of the printed starting sections at high processing speeds, i.e., the printed image is fixed and can no longer smear. The electronic printed image specification device that is assigned to the printer makes it possible to manipulate the printing process during the operation of the system and, if so required, to assign individual printed images to the individual starting sections. Consequently, it is not only possible to manufacture printed products with the same printed image, but printed products with individualized printed images. For example, it is possible to manufacture personal invoice sheets or letters that are printed with specific contents for the respective recipient.

DE 9 111 877 U1 describes a system for printing flat objects which contains an ink jet printer that is coupled to a computer in such a way that the objects can be individually printed. However, the objects only lie loosely on a conveyor belt during their transport, i.e., the transport speed needs to be relatively slow in order to prevent the objects from changing their respective position. The lack of a dryer additionally reduces the processing speed. Although the drying time could be extended by lengthening the conveyor belt, this would result in a significant increase in the longitudinal dimensions of the system.

DE-OS 23 43 109 discloses a feed device for sheet-like objects which is equipped with a vacuum conveyor belt. EP 0 284 215 A1 describes a printer that is equipped with an infrared dryer. DE 195 27264 A1 describes a printing machine that contains several printing stations, between which devices for turning over the objects to be printed are arranged. DE 44 25 199 A1 discloses a printing device for printing web-like materials which contains several printing heads that are controlled by a control unit so as to variably manufacture different printed images.

Advantageous additional developments of the invention are disclosed in the subclaims.

If it is required to print a sheet-like starting section on both sides, the invention proposes to arrange a turning station between the printing station and an additional printing station of comparable design. In this case, one respective printing station that can be controlled by the electronic printed image specification device is provided for each side of the starting section to be printed.

In order to make it possible to process sheet-like starting sections that are delivered in the form of stacks, the transfer device assigned to the feed station is preferably provided with a decollating device that decollates the starting sections and deposits the decollated starting sections on the vacuum conveyor belt either individually or in groups of several successively arranged starting sections.

In order to achieve an exact positioning of the starting sections when they are deposited onto the continuously revolving vacuum conveyor belt, it is advantageous if the starting sections are deposited in a pre-accelerated fashion, preferably such that the transfer takes place at a transfer speed that corresponds to the conveyor belt speed and relative movements are prevented.

It has proved particularly practical to utilize a dryer that operates with infrared radiation and has a high drying efficiency, namely also at a very high transport speed of the printed starting sections and a correspondingly short dwell time of these starting sections within the region of the dryer.

Another advantage of the system can be seen in the fact that it can be operated with a continuous transport of the starting sections to be printed such that no down times which would decrease the throughput occur. A realistic transport speed would lie at 300 m/min. This would make it possible to print approximately 54000 sections per hour if sheet formats of conventional size are processed.

The system is preferably equipped with a delivery station, in which the printed and dried starting sections, i.e., the manufactured printed products, are received, so as to transport the printed products to additional processing stations if so required. The transport to additional processing stations can take place continuously, but it is also possible to stack the printed products until they are additionally transported.

The invention is described in greater detail below with reference to the enclosed figures.

Figure 2:
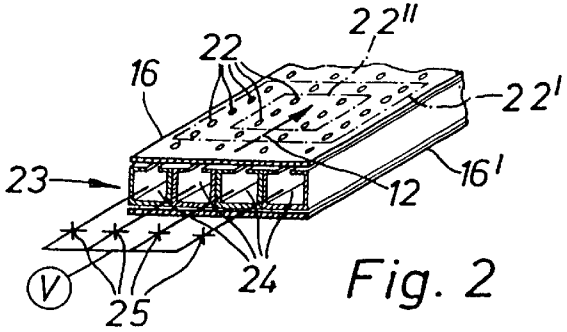

The figures show:

FIG. 1, a first embodiment of the system according to the invention in the form of a schematic perspective representation, and FIG. 2, a cross section through the vacuum conveyor belt used in FIG. 1.

FIG. 1 shows a system 1 that makes it possible to manufacture sheet-like printed products 3 from sheet-like starting sections 2. The starting sections 2 are successively transported through the system 1, with several starting sections 2 always being transported through the system 1 simultaneously. The starting sections 2 are provided with a printed image on one side or, as shown in the embodiment, on both sides. For example, so-called leaves or sheets of pamphlets or magazines, invoice sheets or other formatted and unattached printed products 3 that are provided with individual printed images can be manufactured.

The system 1 shown in the embodiment is equipped with a transport device 4 that is largely formed by a vacuum conveyor belt 5. This transport device 4 extends between a feed station 6 and a delivery station 7. In this case, a linear horizontal progression may be chosen as shown.

The starting sections 2 to be printed are transported through the system 1 from the feed station 6 to the delivery station 7 in the transport direction 12 indicated by arrows. During this process, the starting sections 2 successively pass through a first printing station 13, a turning station 14 and a second printing station 15.

In the embodiment shown, the vacuum conveyor belt 5 contains two belt units 8, 8'. One belt unit (8) extends between the feed station 6 and the turning station 14, and the other belt unit (8') extends between the turning station 14 and the delivery station 7. The first belt unit 8 extends through the first printing station 13, with the second belt unit 8' extending through the second printing station 15.

During their transport by the vacuum conveyor belt 5, the plane, sheet-like starting sections 2 flatly lie on the upper belt section 16 of the conveyor belt 17 of the respective belt unit 8, 8'. Each conveyor belt 17 is realized in the form of an endless belt that is looped around at least two deflection rollers 18, 18' which are arranged at a horizontal distance from one another. The rotational axes of these deflection rollers extend horizontally parallel to one another and perpendicular to the transport direction 12. At least one of the deflection rollers 18, 18' of each belt unit 8, 8' is connected to a driving motor that is not shown in detail and drives the conveyor belts 17 such that they unidirectionally revolve around the deflection rollers 18, 18'. However, it would also be conceivable to provide only one drive unit for all belt units 8, 8'.

The conveyor belt 17 is preferably realized in the form of a metal band and equipped with a series of suction opening 22 (see FIG. 2) that perpendicularly extend through the conveyor belt 17 and are distributed over the belt plane. A vacuum chamber arrangement 23 that, for example, is designed in a box-like fashion extends between the upper belt section 16 and the lower belt section 16' of each conveyor belt 17. The vacuum chamber arrangements respectively contain one or more vacuum chambers 24 that extend(s) in the longitudinal direction of the respective belt unit 8, 8' and is/are connected to a vacuum generator V, e.g., a suction pump. This vacuum generator causes a suction effect in the vacuum chambers 24 such that surrounding air is attracted by suction through the suction openings 22 in the upper belt section 16. This results in a flat starting section 2 which was deposited on the upper belt section 16 to be attracted by suction and retained.

FIG. 2 indicates that the vacuum chambers 24 may be designed in such a way that they can be variably switched on or off. This is realized by arranging a shut-off valve 25 between each vacuum chamber 24 and the vacuum generator V, with said shut-off valve making it possible to selectively produce or interrupt the connection. Due to this measure, arbitrary vacuum chambers 24 can be activated and deactivated depending on the format of the starting sections 2 to be transported.

In the embodiment according to FIG. 2, four longitudinally extending vacuum chambers 24 are provided adjacent to one another. In this case, all vacuum chambers are activated and connected to the vacuum generator V in order to retain starting sections 2' of a larger format. In order to retain the starting sections 2", the two outer vacuum chambers 24 can be deactivated by closing the shut-off valves 25 such that no suction effect is created at the suction openings 22 that communicate with these vacuum chambers and a starting section 2" of a smaller format is merely retained by the vacuum acting through the suction openings 22 that communicate with the two inner vacuum chambers 24.

The materials of the sheet-like starting sections 2 to be printed are, in principle, arbitrary, but systems of this type usually serve for processing thin; foil-like paper or cardboard materials.

While passing through the two printing stations 13, 15, the starting sections 2 are, for example, aligned in a horizontal plane. The first side of the sheet-like starting sections 2 which points upward is provided with a printed image in the first printing station 13. When the starting sections 2 pass through the turning station 14, they are turned by 180° such that the second side which previously pointed downward is now situated on top and can be printed while it passes through the second printing station 15.

The handling of the starting sections 2 in the turning station 14 may also take place with the aid of a vacuum. For example, the individual sheets could be taken hold of by a suction device and turned, with the starting sections 2 being turned by 180° referred to the transport direction 12 in accordance with the arrow 30 in the embodiment shown.

In the embodiment shown, the two printing stations 13, 15 have an identical design, so the following description is limited to the first printing station 13 situated adjacent to the feed station 6. The description of this printing station applies correspondingly to the second printing station 15.

The printing station 13 is equipped with a preferably contactless printer 26 that is realized in the form of an ink jet printer in the embodiment shown. The printing station contains several printing units 27 that are arranged adjacent to one another and connected to printing color supply containers 29 via hoses 28 and pumps that are not illustrated in detail. The printing units 27 are supplied with printing colors by these supply containers, with this series of printing units 27 making it possible to realize a multicolor image in addition to a single color image.

The printing units 27 are arranged slightly above the imaginary transport path, along which the starting sections 2 to be printed move while they pass through the system 1. Color jets and ink jets which are ejected under pressure very quickly apply the desired printed image—e.g., arbitrary texts, images or graphics—onto the starting section 2 to be printed which moves past the printer 26 with a high speed.

In order to reliably fix the applied printed image despite the high transport speed of the starting sections 2, a dryer 32 is arranged behind the printer 26 viewed in the transport direction 12. The starting sections 2 pass through this dryer after they are printed. In the embodiment shown, the dryer is realized in the form of an infrared radiation dryer that, in particular, generates so-called near infrared radiation. This infrared radiation is highly effective and causes a rapid drying of the applied color particles.

It is advantageous if the dryer 32 is equipped with at least one surface dryer 33 that extends over part of the transport path of the starting sections 2. This surface dryer can be arranged horizontally above the conveyor belt 17, namely at the shortest possible distance from the transport path. This surface dryer may have an essentially hood-like shape as shown.

In the embodiment shown, the aforementioned feed station 6 is designed in such a way that it allows the processing of starting sections 2 in stacked form. A stack of starting sections is identified by the reference symbol 34 in FIG. 1.

The transfer of the starting sections 2 from the feed station 6 to the adjacent belt unit 8 is realized with the aid of a transfer device 35 that is equipped with a decollating device 36 in the embodiment shown. This decollating device may be equipped with a vacuum suction arrangement 37 that respectively lifts the top starting section 2 off the stack 34 and deposits this starting section onto the upper section 16 of the belt unit 8 in accordance with the arrow 38.

It would also be conceivable to choose a design, in which not only one starting section 2 is deposited onto the transport device 4 per time unit, but rather an entire series of successively arranged starting sections 2.

In addition, it is advantageous to design the transfer device 35 such that it transfers the starting sections 2 onto the moving conveyor belt 17 of the adjacent belt unit 8 in a pre-accelerated fashion. It is particularly practical to transfer the starting sections onto the conveyor belt 17 with a transfer speed that essentially corresponds to the belt moving speed with respect to its direction and value.

Once the starting sections 2 have passed through both printing stations 13, 15, they are printed and can be designated as printed products 3 that are received by a take-over device 42 in the subsequently arranged delivery station 7. This take-over device 42 may be designed in such a way that it continuously transports the printed products 3 to a subsequently arranged finishing treatment. In the embodiment shown, the printed products are stacked by the take-over device 42 and can be transported away in the form of stacks.

The described system allows very high operating speeds while achieving a high precision. In addition, a high flexibility is achieved because a rapid reaction to unexpectedly received printing orders is possible. The individual printing of sheets is also possible, i.e., sheet-like starting sections that are processed in immediate succession can be easily provided with different printed images.

This flexibility is attained with an electronic printed image specification device 43 that is schematically indicated in FIG. 1 and cooperates at least with the printer 26 of all printing stations 13, 15. However, it is preferred that the remaining devices of the system 1 can also be controlled by the printed image specification device 43. In the embodiment shown, this specification device is linked to the drive units of the transport device 4, the two printers 26, the two dryers 32, the feed station 6 and the delivery station 7, with the corresponding control lines being identified by the reference symbol 44. Due to this measure, it is possible to control the entire system such that all moving sequences can be reliably coordinated with one another.

The printed image specification device 43 allows, in particular, a variable specification of the printed images to be produced by the printers 26, namely such that the individual starting sections are printed with specific printed images. This makes it possible to personalize the printed images, e.g., by individually preparing the printed image with the aid of specifications that are adapted to a certain recipient.

Consequently, the invention makes it possible to print series of successive starting sections 2 with identical printed images or to print successively processed starting sections 2 with an arbitrary printed image that can be specified with the printed image specification device 43. The printed image specification device 43 may contain a memory, in which an arbitrary number of printed images is stored. These printed images can be retrieved during the operation of the system, with the printers 26 being correspondingly controlled.

In the embodiment shown, the printed image specification device 43 contains, among other things, a display 45 for displaying the operating sequence as well as an alphanumeric input field 46. One can also ascertain that this device contains an interface.47 which makes it possible to produce a connection to an external electronic data processing system, i.e., an easy transmission of data between a computer and the printed image specification device 43 is possible.

The specification of the printed images to be produced is preferably also variable such that practically arbitrary printed images can be produced by suitably programming and/or inputting data.

The coordination between the printing process and the transport of the starting sections 2 to be printed is preferably realized with the aid of a sensor arrangement that is not shown in detail and that is able to determine certain positions of the continuously transported starting sections 2. Consequently, the application of color onto the starting sections 2 can always take place by taking into consideration the transport speed of the starting sections 2.

It should be mentioned once again that the sensor arrangement which makes it possible to determine the positions of the starting sections 2 being transported in connection with the linkage between the printed image specification device 43 and the other relevant devices of the system 1 for control purposes allows a very flexible operation with high operating speeds. The printing process and the transport speed are linked to one another, i.e., the transport speed can be changed during the printing process if, for example, the product specifications are changed, with a uniformly high-quality printing product always being obtained. Possible fluctuations in the transport speed can also be easily compensated due to the linkage between the specification device and the remaining components of the system.

What is claimed is:

1. A system for manufacturing sheet-like printed products, comprising:

a transport device that transports starting material to be printed from a feed station through a printing station, in which at least one printed image is applied onto the starting material, the transport device defining a transport path extending in a transport direction, wherein the feed station includes a transfer device for transferring starting material in the form of sheet-like starting sections to the transport device, the transport device is equipped with a vacuum conveyor belt, on which the sheet-like starting sections to be printed are held during their transport due to the vacuum, and the printing station is equipped with a printer that operates in a contactless fashion as well as a dryer that is arranged behind the printer viewed in the transport direction of the starting sections, an electronic printed image specification device that cooperates with the printer and makes it possible to specify individual printed images for the sheets, a sensor arrangement for determining certain positions of the continuously transported starting sections, wherein the printed image specification device is also linked to the feed station, the transport device and the dryer for control purposes, and wherein the dryer comprises of an infrared radiation dryer that generates near-infrared radiation which directly falls onto the printed image, wherein a turning station is provided, with the starting sections that were printed on one side of the printing station being turned in said turning station such that the other side of the respective starting sections can also be printed, wherein an additional printing station is arranged behind the turning station viewed in the transport direction of the starting sections, with the other side of the turned sheet-like starting sections being printed in the second printing station, and wherein the additional printing station is substantially identical to the first printing station.

2. The system according to claim 1, wherein the transfer device includes a decolating device that transfers individual starting sections from a stack to the transport device.

3. The system according to claim 1, wherein the transfer device includes a decollating device that transfers individual starting sections from a stack to the transport device in a pre-accelerated fashion with a transfer speed that substantially corresponds to the belt moving speed and direction.

4. The system according to claim 3, wherein the printer includes a plurality of printing units for printing single color and/or multicolor printed images.

5. The system according to claim 4, further comprising at least two printing color supply containers that serve for supplying the respective colors to the printer.

6. The system according to claim 1, wherein the dryer includes at least one surface dryer that extends over at least part of the transport path of the starting sections.

7. The system according to claim 1, wherein the transport path of the starting sections extends horizontally through the printing station, with the sheet-like starting sections being aligned in a horizontal plane, and with the printer and the dryer being arranged above the transport path.

8. The system according to claim 1, wherein the vacuum conveyor belt contains adjacent vacuum chambers that extend in the transport direction of the starting sections and can be variably switched on or off by the operation of a shut-off valve.

9. The system according to claim 1, wherein the transport of the starting sections during the printing processes is substantially horizontal.

10. The system according to claim 1, wherein a delivery station is provided, in which the printed products obtained after the printing process are received by the vacuum conveyor belt, with said delivery station also being linked to the printed image specification device for control purposes.

11. The system according to claim 1, wherein the printer is an ink jet printer.

* * * * *